US009005095B2

(12) United States Patent
D'Anglade

(10) Patent No.: US 9,005,095 B2
(45) Date of Patent: Apr. 14, 2015

(54) METHOD FOR MANUFACTURING RESTORED WINDING CORES

(75) Inventor: Pierre-Michel D'Anglade, Montreal (CA)

(73) Assignee: Abzac Canada Inc., Drummondville (Quebec) (CA)

( * ) Notice: Subject to any disclaimer, the term of this patent is extended or adjusted under 35 U.S.C. 154(b) by 1090 days.

(21) Appl. No.: 13/004,355

(22) Filed: Jan. 11, 2011

(65) Prior Publication Data

US 2011/0119885 A1 May 26, 2011

Related U.S. Application Data

(62) Division of application No. 11/721,294, filed as application No. PCT/CA2005/001891 on Dec. 8, 2005, now abandoned.

(60) Provisional application No. 60/634,113, filed on Dec. 8, 2004.

(51) Int. Cl.
*B31C 11/04* (2006.01)
*B65H 75/50* (2006.01)

(52) U.S. Cl.
CPC ..... *B65H 75/505* (2013.01); *Y10T 29/49071* (2013.01); *Y10T 29/49746* (2013.01)

(58) Field of Classification Search
USPC ..... 493/276, 277, 299, 300, 301, 303; 242/520
See application file for complete search history.

(56) References Cited

U.S. PATENT DOCUMENTS

| | | | |
|---|---|---|---|
| 1,137,470 | A | 4/1915 | Elixman |
| 2,716,315 | A | 8/1955 | Jacoby |
| 2,734,432 | A | 2/1956 | Robinson et al. |
| 2,760,549 | A | 8/1956 | Nash et al. |

(Continued)

FOREIGN PATENT DOCUMENTS

| | | | |
|---|---|---|---|
| CA | 2121273 | A1 | 10/1994 |
| CA | 2452780 | A1 | 1/2003 |

(Continued)

OTHER PUBLICATIONS

A European Office Action dated Jul. 20, 2010, which issued during the prosecution of European Patent Application No. 05 819 626.2.

*Primary Examiner* — Sameh H. Tawfik
(74) *Attorney, Agent, or Firm* — Fish & Richardson P.C.

(57) ABSTRACT

The present invention provides a restored winding core and a method for manufacturing the same, wherein at least one discarded winding core is first collected. At least one of the extremities of the discarded winding core is internally ground on a predetermined grinding distance to remove the crimping portion and provide a ground portion thereon. The ground portion defines a female joint socket extending at the corresponding extremity of the discarded winding core for providing a machined core extremity. The method also comprises the step of providing at least one hollow insert tube diametrically snugly fitting into the female joint socket. The at least one insert tube is inserted inside the corresponding female joint socket for providing a restored core extremity. The present invention thus allows to restore the damaged extremities of a winding core which can then be reused as a new winding core of the same length. The present method also allows to join several discarded winding cores end to end for providing a restored winding core of a longer length.

7 Claims, 10 Drawing Sheets

(56) References Cited

U.S. PATENT DOCUMENTS

| | | | | |
|---|---|---|---|---|
| 3,385,179 | A | 5/1968 | Roe | |
| 5,586,963 | A | 12/1996 | Lennon et al. | |
| 6,051,092 | A | 4/2000 | Lynch et al. | |
| 6,632,306 | B1 * | 10/2003 | Roberts et al. | 156/95 |
| 7,322,922 | B2 | 1/2008 | Johansson et al. | |
| 2006/0180696 | A1 | 8/2006 | Nilsson | |

FOREIGN PATENT DOCUMENTS

| | | | |
|---|---|---|---|
| JP | 2003206079 | A | 7/2003 |
| WO | WO2004087551 | A1 | 10/2004 |

* cited by examiner

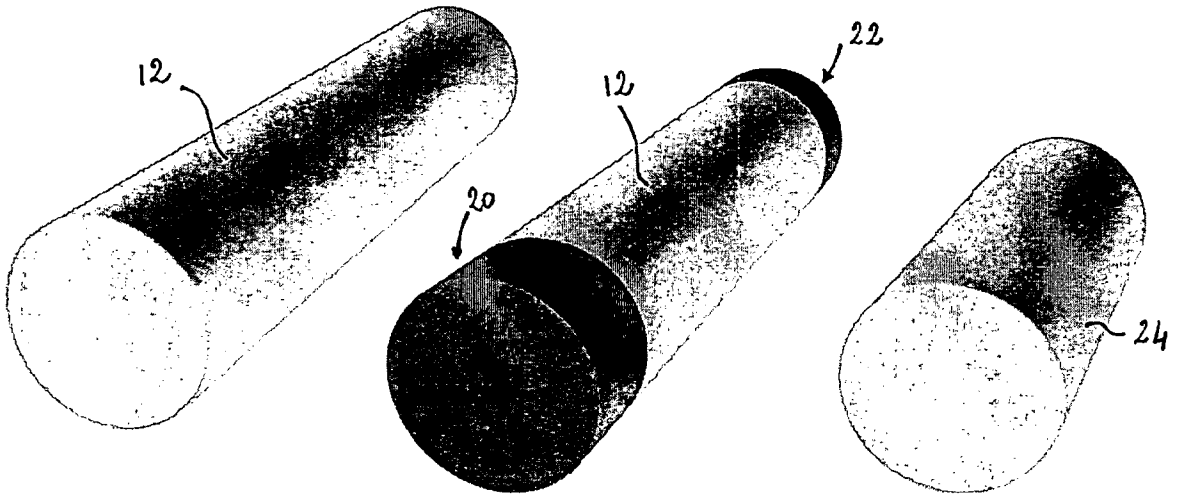
FIG. 2A (PRIOR ART)
FIG. 2B (PRIOR ART)
FIG. 2C (PRIOR ART)
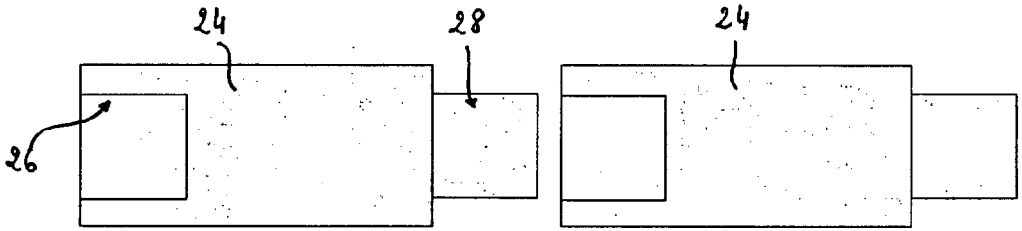
FIG. 2D (PRIOR ART)
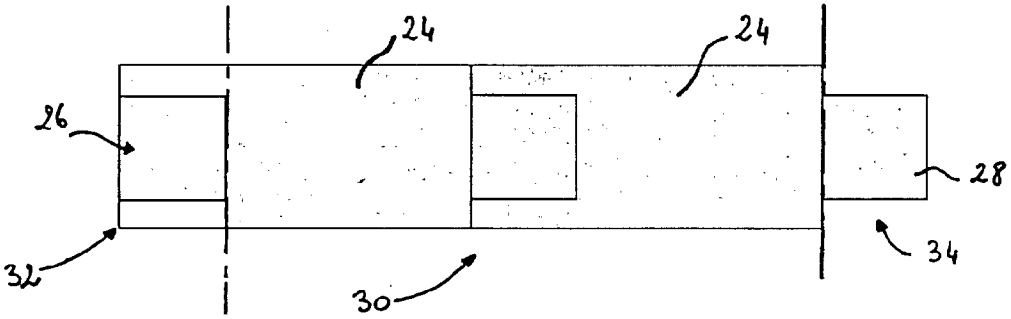
FIG. 2E (PRIOR ART)

METHOD FOR MANUFACTURING RESTORED WINDING CORES

CROSS REFERENCE TO PRIOR APPLICATION

This application is a Division Application of U.S. Ser. No. 11/721,294, filed Jun. 8, 2007, which is the U.S. National Phase of International Application No. PCT/CA2005/001891, filed Dec. 8, 2005, and published in English on Jun. 15, 2006, which claims priority from U.S. Provisional Application No. 60/634,113, filed Dec. 8, 2004 and the disclosure of each application is incorporated herein by reference in their entirety.

FIELD OF THE INVENTION

This invention generally relates to winding cores in the field of winding industry, and more particularly concerns a restored winding core for winding products such as papers. It also concerns a method and an apparatus for manufacturing such restored cores.

BACKGROUND OF THE INVENTION

Newsprint and other paper used for printing are generally shipped from the paper mill in large rolls. When the rolls are made up at the paper mill, they are wound on a tubular core. Typically, the cores are made of liner and/or chip board.

In the press room or other paper process plant, the roll is mounted on an unwind apparatus with the core of the roll journaled on chucks. Once the web of paper has been unwound from the core, the core is generally discarded or returned to a paper mill to be recycled as waste fiber.

Thus, until recently, it has not been contemplated to reuse a winding core once it has been utilized, other than to cut the core down to a smaller size. Indeed, it has been found that after a single use, the winding core is somewhat damaged. More particularly, the internal extremities of the core which have been crimped during unwinding are damaged and cannot be conveniently journaled on chucks once again. Thus, the practice in the industry is to discard the winding cores once a roll of paper web has been unwound therefrom. The discarded single use winding core is then returned to the paper mill as scrap liner board to be recycled as paper fiber.

FIG. 1 (PRIOR ART), illustrates a paper roll 10 having a winding core 12 journaled on chucks 14 at crimping portions 16, 18. The two chucks 14 support the core 12 and control the rotation of the paper roll 10, as well known in the art. Once the paper has been unrolled from the core 12, the core is intact on its length but is damaged at its internal extremities known as the crimping portions 16, 18.

Known in the art, there are U.S. Pat. Nos. 5,845,871 and 6,051,092, both granted to Lynch et al., which describe a recycled core for winding paper, a method for manufacturing the same and an apparatus for recycling cores. FIGS. 2A to 2E (PRIOR ART) illustrate the conventional prior art method described in the above-mentioned US patents used for manufacturing recycled winding cores. Discarded winding cores 12 are first collected, as illustrated on FIG. 2A. The ends 20, 22 of the core 12 which comprise the crimping portions 16, 18 are then trimmed to remove the crimping portions 16, 18 off the core 12, as illustrated on FIG. 2B. FIG. 2C illustrates a trimmed core 24 which is undamaged and smaller than the original core 12. At this point, a female joint socket 26 is formed at one end of the core 24 while a complementary male joint socket 28 is formed at the other end of the core 24, as illustrated on FIG. 2D. A plurality of such cores 24 are then joined end to end with adhesive to form an elongated multiple-length core master 30, as illustrated on FIG. 2E. An elongated web of finishing material (not shown) equivalent to the length of the multi-length core master 30 and having a width corresponding to the circumference of the core master 30 is then wrapped around the core master 30 with adhesive so as to provide a finished core master. The extremities 32, 34 of the core master 30 are finally trimmed so as to remove the two opposed joint sockets 26, 28, as illustrated on FIG. 2E. The core master 30 can then be cut into recycled winding cores of suitable length. U.S. Pat. No. 6,453,966, which comes from the two above-mentioned US patents, describes an apparatus for wrapping a layer of material on such recycled cores.

These patents provide great improvement over the prior art since most of the length of the core can be recycled. However, with the above-described method, the whole length of the core still cannot be entirely recycled. Moreover, this method requires a complex equipment to machine the cores. In fact, with such a method, a specific machine is used for manufacturing a recycled core of a predetermined length. Thus, to manufacture a recycled core of another length, another specific machine would be required. The same issue arises concerning the diameter of the recycled core since a specific grinding tool is required to form the joint sockets.

Also of interest, there is PCT application No. PCT/JP97/01125, published under publication No. WO98/43908, which describes a winding core, a method for producing the same and an insert member for producing the winding core. Also of interest, there is Japanese patent application No. 2002-006953 published under publication No. 2003-206079 which describes a recycled paper tube and its manufacturing method.

However, these two above-mentioned patent applications still do not allow to recycle the whole length of the used cores in an easy and economical manner.

Therefore, it would be desirable to provide an improved method and an apparatus for economically and easily reclaiming discarded winding cores to acceptable standards such that the restored winding cores can be reused as winding cores.

SUMMARY OF THE INVENTION

An object of the present invention is to provide a restored core and a method for manufacturing the same that satisfy the above-mentioned needs.

Accordingly, the present invention provides a restored winding core. The restored winding core is provided with a winding core having a first and a second extremity. At least one of the extremities of the winding core is provided with a female joint socket extending therein. The restored winding core is also provided with at least one hollow insert tube having a diameter snugly fitting into the female joint socket. The insert tube extends inside the female joint socket for providing a restored core extremity.

In one embodiment of the invention, each of the extremities of the winding core is provided with a respective one female joint socket extending therein. The restored winding core further has first and second hollow insert tubes. Each of the insert tubes extends inside a respective one of the female joint sockets for respectively providing first and second restored core extremities.

In another embodiment of the invention, the restored winding core further has an additional winding core having first and second extremities. At least one of the extremities of the additional winding core is provided with a female joint socket extending therein. The insert tube has a first and a second tube extremity. Each of the tube extremities is inserted into a respective one female joint socket of a respective one winding core for joining the winding core and the additional winding core end to end to provide a recycled master core.

The invention also proposes a method for restoring a winding core comprising the steps of:

a) collecting at least one discarded winding core, the core having a first and a second extremity;

b) internally grinding on a predetermined grinding distance at least one of the extremities of the discarded winding core to provide an internal ground portion thereon, the ground portion defining a female joint socket extending at the corresponding extremity of the discarded winding core for providing a machined core extremity;

c) providing at least one hollow insert tube diametrically snugly fitting into the female joint socket; and d) inserting the insert tube inside the joint socket for providing a restored core extremity.

In one embodiment of the invention, in the step b), each of the first and second extremities is internally ground on the predetermined grinding distance to respectively provide the internal ground portion thereon. Moreover, in the step c), a first and a second hollow insert tube are provided. Furthermore, in the step d), each of the first and second insert tubes are inserted inside a respective one of the joint socket for providing first and second restored core extremities.

In another embodiment of the invention, in the step a), a first and a second discarded winding core are provided. Moreover, in the step d), the insert tube has a first and a second tube extremity. Each of the tube extremities is inserted into a respective one female joint socket of a respective one winding core for joining the first and second discarded winding cores end to end to provide a recycled master core.

In a further embodiment of the invention, the method further comprises additional steps of:

providing a finishing fold; and winding the finishing fold around the recycled master core over the entire length thereof, thereby providing a restored winding core. More preferably, the finishing fold is spirally wound around the recycled master core.

Advantageously, thanks to the particular arrangement provided by the present invention, the damaged extremities of a discarded winding core can be restored. The whole length of the discarded winding core can therefore be easily entirely reclaimed without requiring expensive and laborious machining steps, nor the use of a complex equipment.

Moreover, the present invention advantageously provides restored winding cores of any convenient length, and particularly restored winding cores longer than those provided in the prior art.

The invention also proposes an apparatus for manufacturing restored winding cores.

BRIEF DESCRIPTION OF THE DRAWINGS

These and other objects and advantages of the invention will become apparent upon reading the detailed description and upon referring to the drawings in which:

FIGS. 2A to 2E (PRIOR ART) are schematic representations illustrating the successive steps of a conventional method for recycling winding cores, according to the prior art.

Figure 1:
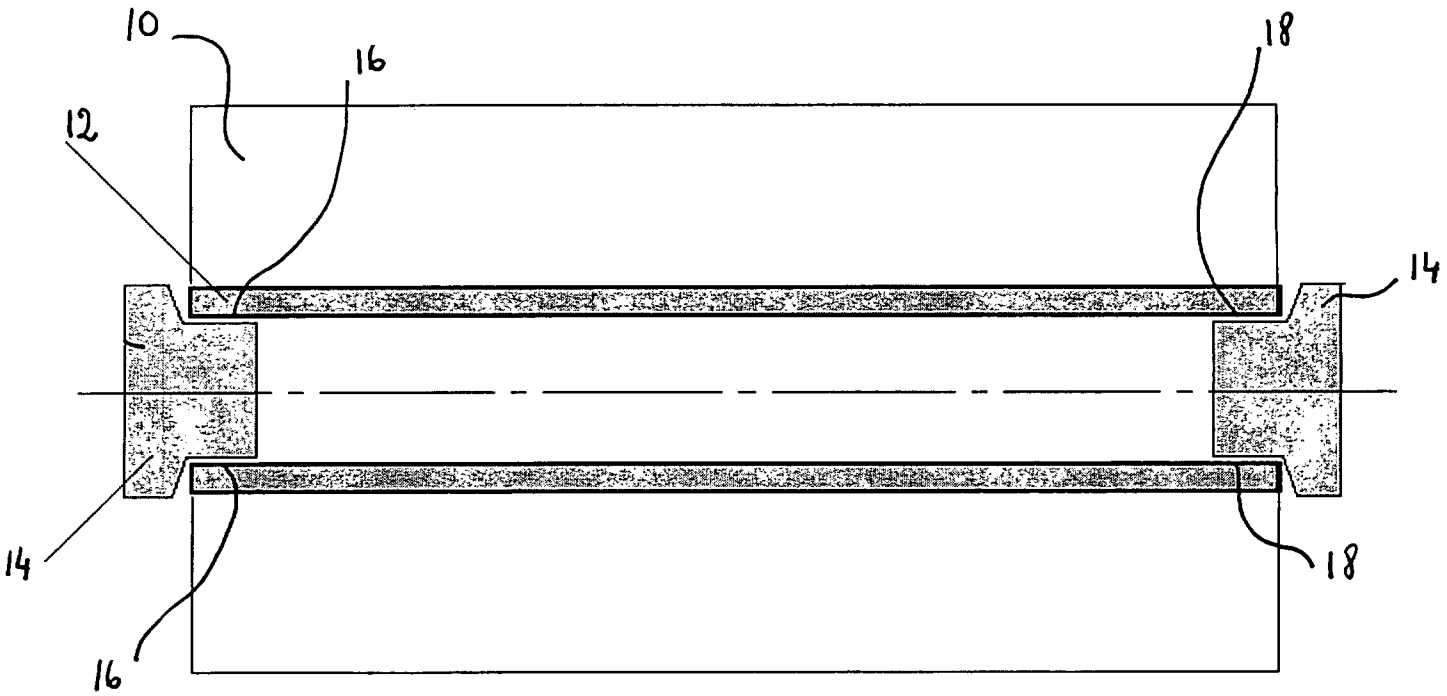
FIG. 1 (PRIOR ART)
FIG. 1 (PRIOR ART) is a schematic representation of a paper roll having a winding core journaled on chucks.

While the invention will be described in conjunction with example embodiments, it will be understood that it is not intended to limit the scope of the invention to such embodiments. On the contrary, it is intended to cover all alternatives, modifications and equivalents as may be included as defined by the appended claims.

DESCRIPTION OF A PREFERRED EMBODIMENT

In the following description, similar features in the drawings have been given similar reference numerals and, in order to lighten the figures, some elements are not referred to in some figures if they were already identified in a precedent figure.

The present invention concerns a restored winding core, a method and an apparatus for manufacturing the same. The restored winding core of the present invention and its manufacturing method are particularly advantageous since they provide an economical and easy reclaiming of discarded winding cores to acceptable standards in restoring the damaged extremities thereof such that the restored winding core can be reused as a new winding core.

Throughout the present description, the invention will be described in the particular field of paper industry but it should be understood that the present invention could also be used in any other particular winding application such as stretch-film winding as a non-limitative example. The method and the apparatus can advantageously provide restored winding cores of any convenient length, and particularly restored winding cores longer than those of the prior art, as will be greater detailed thereinafter. Moreover, the restored winding cores obtained from the method of the present invention advantageously have a visual appearance similar to the one of a new winding core. Furthermore, a major advantage of the present invention resides in the fact that the whole length of the discarded winding core can be easily reclaimed without requiring expensive and laborious machining steps, nor the use of a complex equipment.

Figure 3A:
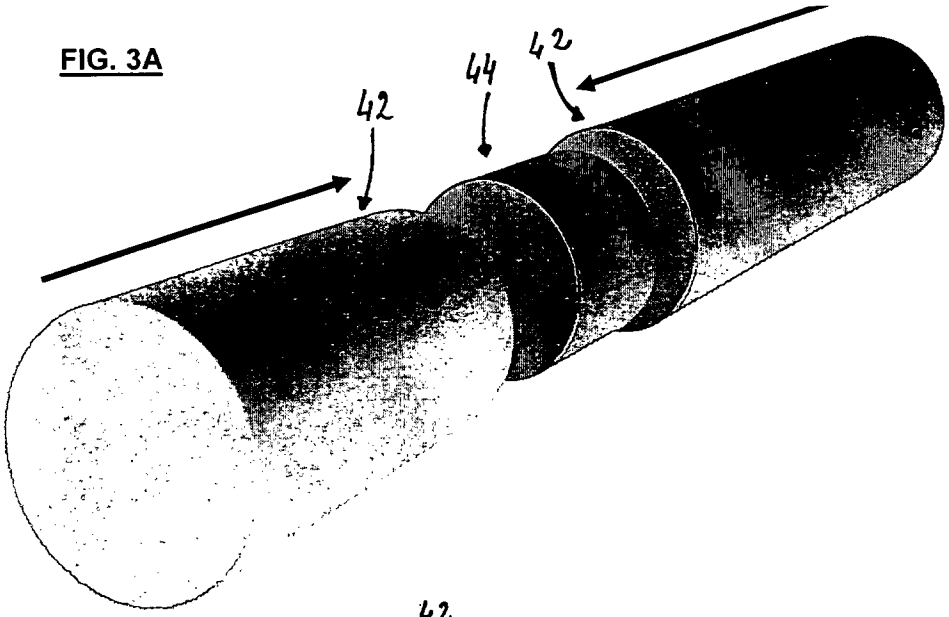
FIGS. 3A to 3C are schematic representations illustrating the steps of the method for restoring a winding core according to a preferred embodiment of the present invention.
Figure 3B:
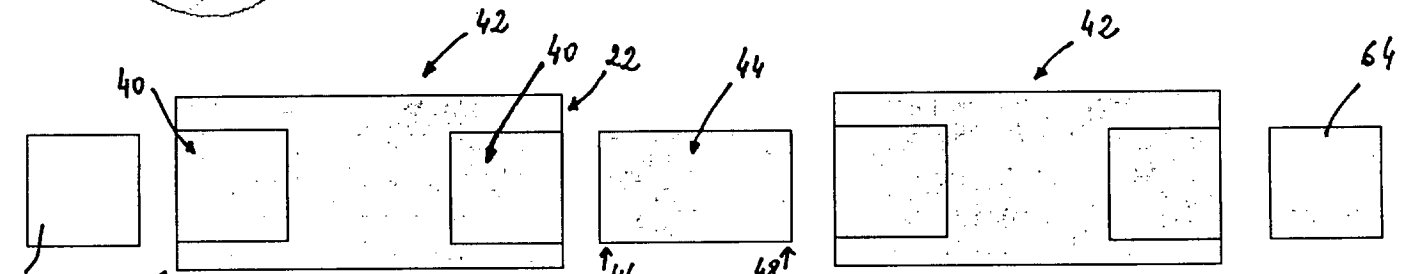
Figure 3C:
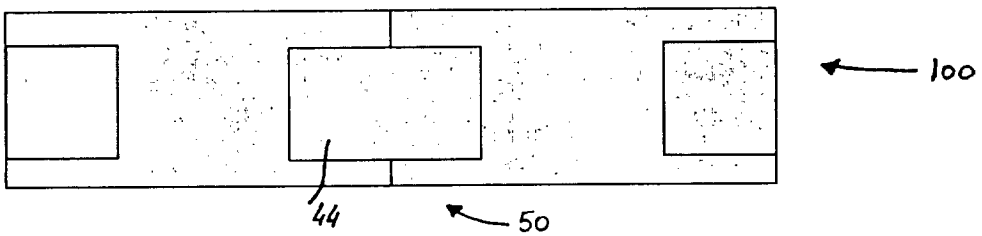

Referring to FIGS. 3A to 3E and also to FIGS. 4 and 5, the principles of the method for manufacturing a recycled winding core 100 according to the present invention will now be described. Contrary to the known prior art method described above with reference to FIGS. 2A to 2E, the extremities 20, 22 of the discarded core 12 which comprise the crimping portions 16, 18 are not trimmed but are advantageously restored. The entire length of the discarded core 12 can therefore advantageously be reclaimed. In the method for restoring a winding core according to the present invention, at least one discarded winding core 12, preferably round-shaped, having a first and a second extremity 20, 22 is first collected. As can be better seen on FIGS. 4 and 5, at least one of the first and second extremities 20, 22, but preferably both, is internally ground on a predetermined grinding distance 36 to remove the corresponding crimping portion 16, 18 and provide an internal ground portion 38 on the corresponding extremity 20, 22. Of course, only one of the extremities 20, 22 can be restored, but preferably, both extremities 20, 22 are advantageously restored. The ground portion 38 defines a female joint socket 40, preferably round-shaped, extending at the corresponding extremity 20, 22 of the discarded winding core 12 for providing a machined core extremity. FIG. 4 illustrates a grinding station for performing the grinding of the extremities 20, 22, which can advantageously be used in the present method. Of course, any other convenient means for grinding the extremities 20, 22 of the core 12 could also be envisaged. Nevertheless, the illustrated grinding station is particularly advantageous since it allows to grind the extremities 20, 22 of a discarded winding core 12 of any predetermined diameter.

Figures 3D, 3E:
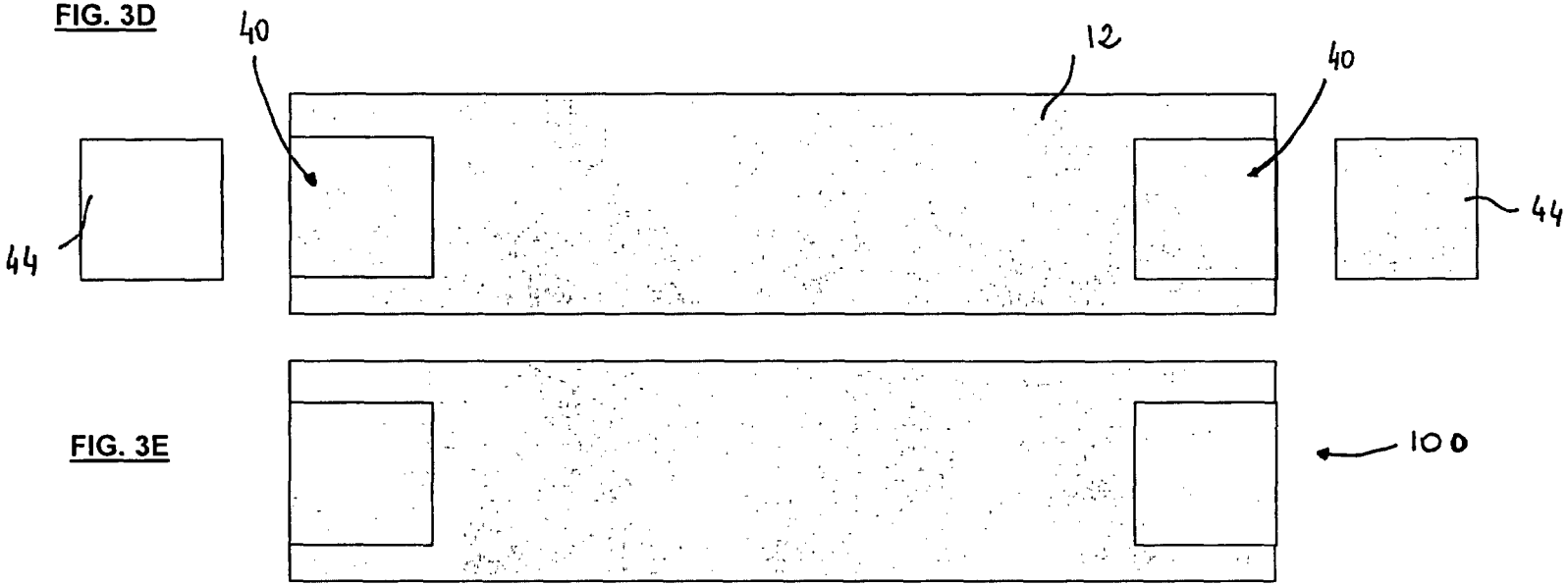
FIGS. 3D and 3E are schematic representations illustrating the steps of the method for restoring a winding core according to another preferred embodiment of the present invention.
Figure 4:
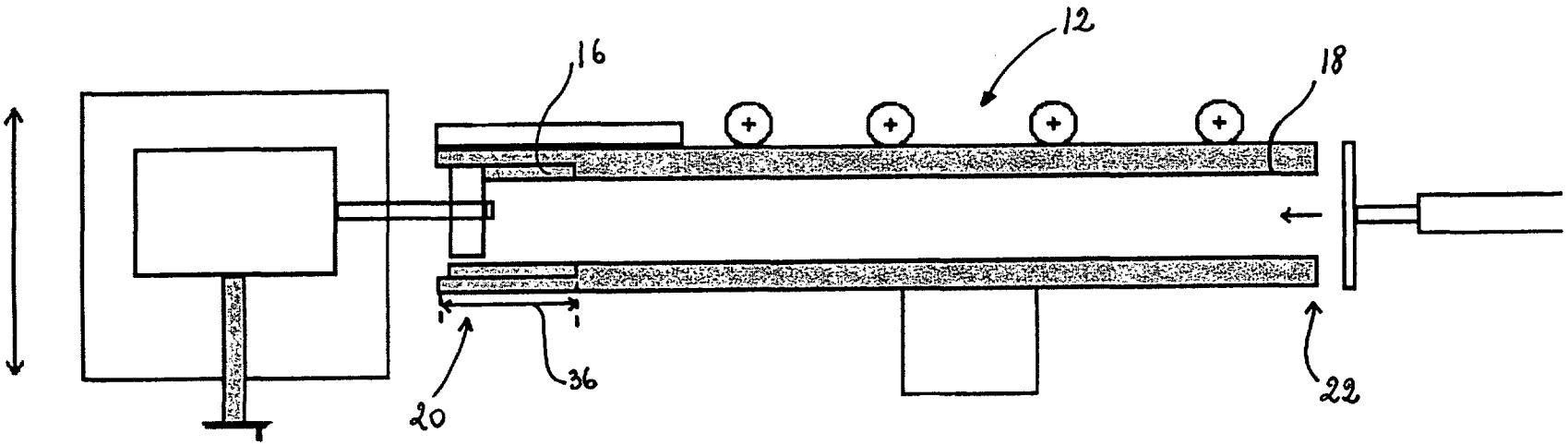
FIG. 4 is a schematic representation of a machining station used for grinding the extremities of a discarded winding core, according to a preferred embodiment of the present invention.
Figure 5:
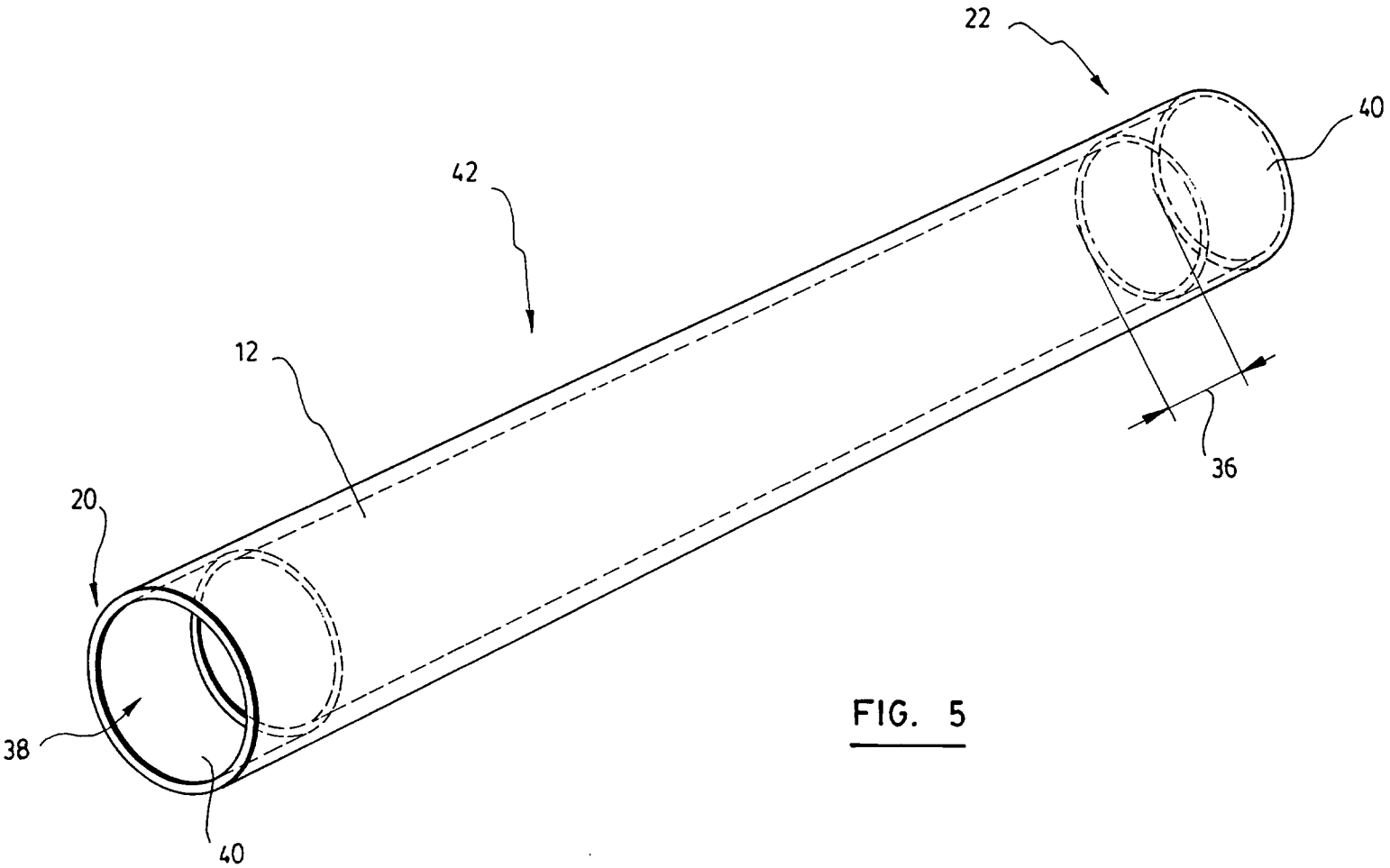
FIG. 5 is a perspective representation of a winding core wherein the internal extremities have been ground, according to the present invention.
Figures 6A, 6B:
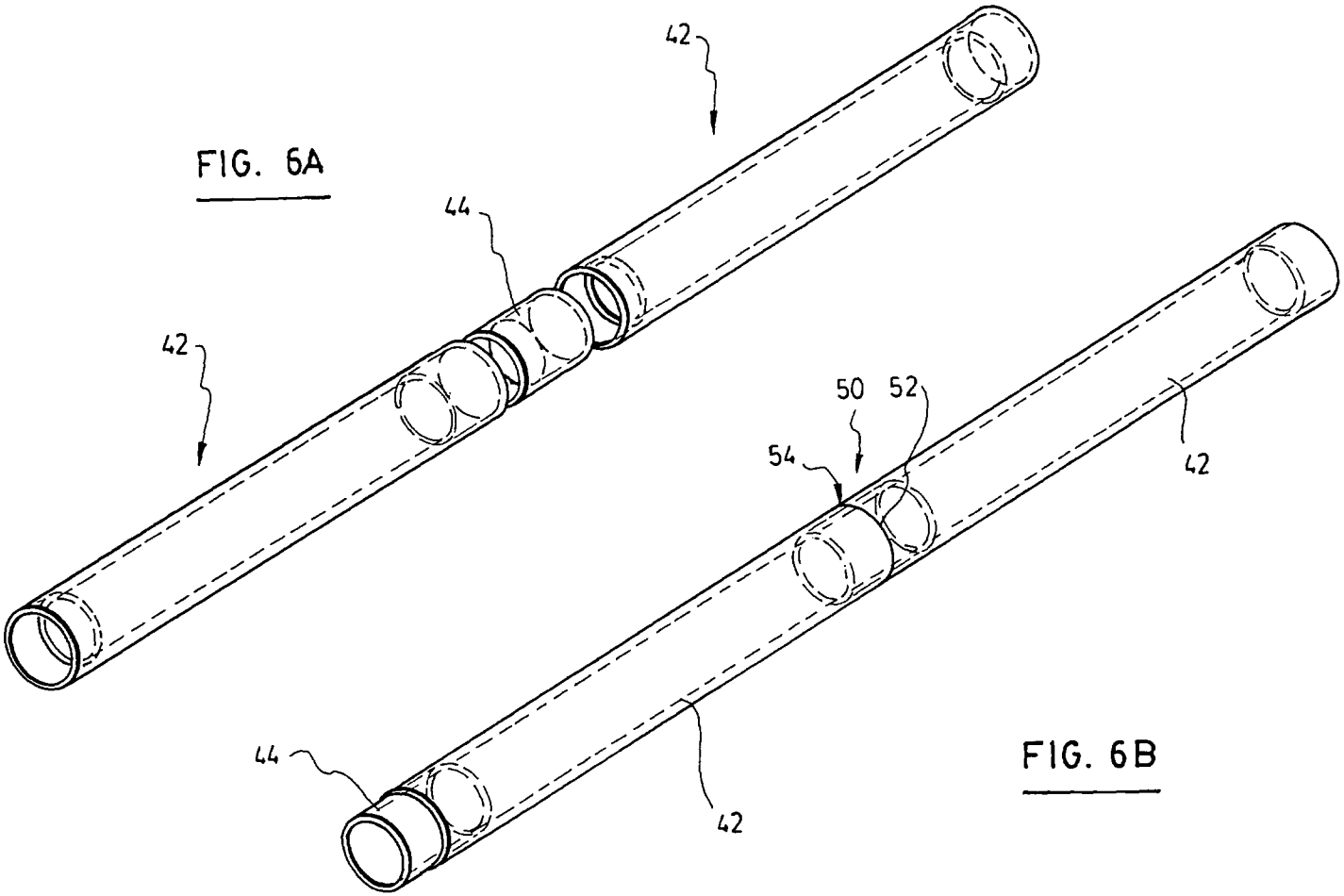
FIG. 6A is an exploded perspective representation of a restored winding core according to a preferred embodiment of the present invention.
FIG. 6B is a perspective representation of the restored winding core of FIG. 6A once it has been assembled.
Figures 7A, 7B:
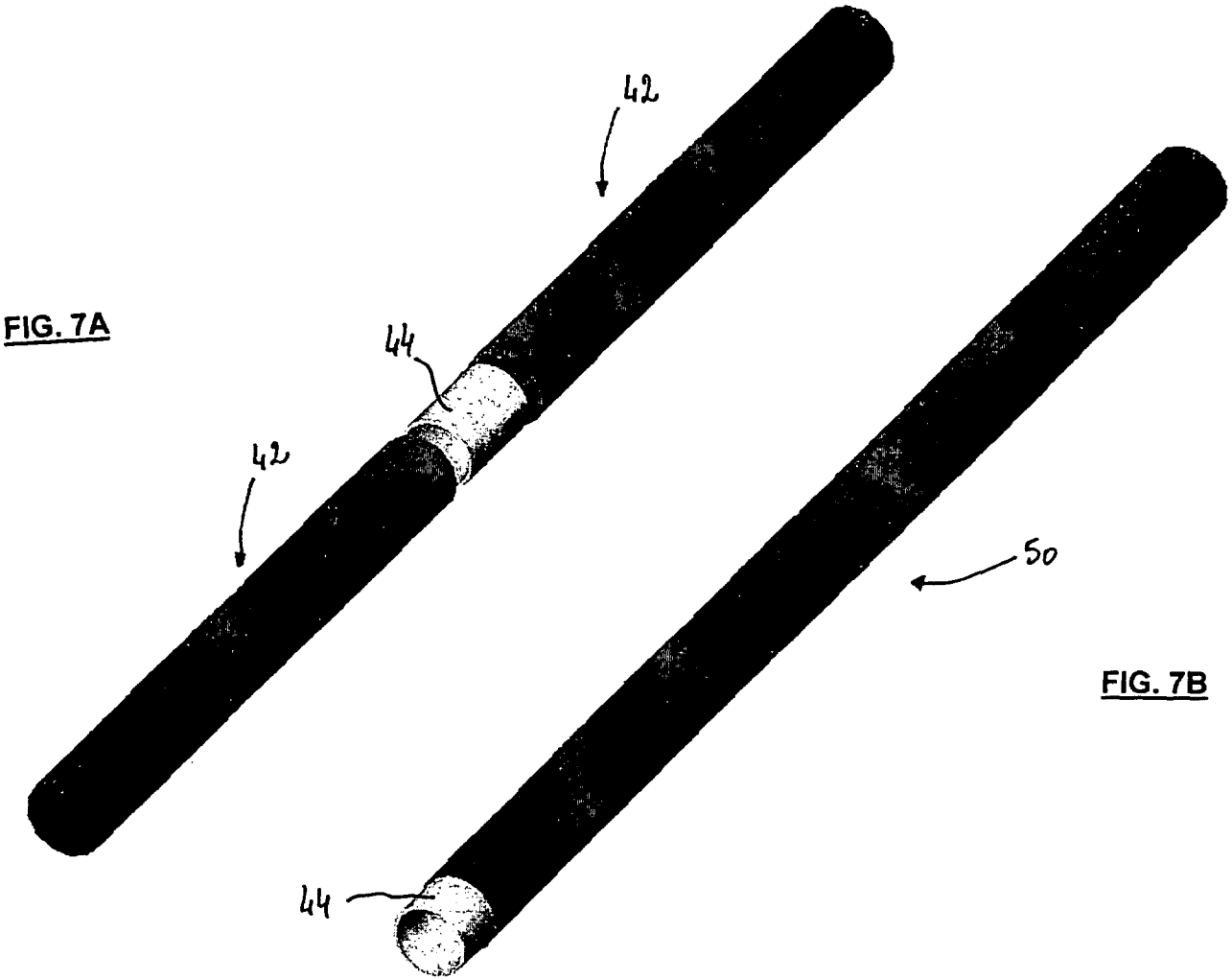
FIG. 7A is an exploded perspective view of the restored winding core shown in FIG. 6A.
FIG. 7B is a perspective view of the recycled winding core shown in FIG. 6A once it has been assembled.

Still referring to FIGS. 3D, 3E and 5, at least one hollow insert tube 44 diametrically snugly fitting into the female joint socket 40 is then provided. The insert tube 44 is inserted inside the joint socket 40 for providing a restored core extremity. Of course, as explained above and as illustrated, both extremities 20, 22 are advantageously restored, even if one can envisage to restore a single one extremity.

The method of the present invention, which allows to restore a damaged extremity of a discarded winding core, can then advantageously be used to restore a discarded winding core which can then be reused as a new winding core of the same length, as it will be detailed thereinafter with reference to FIGS. 3D and 3E. With the particular arrangement provided by the present method, one can also envisage to join several discarded cores end to end while restoring their damaged portions for providing a restored winding core of a longer length, as it will be more detailed thereinafter with reference to FIGS. 3A to 3C.

Referring now to FIGS. 3D to 3E, a first preferred embodiment of the present invention wherein at least one, but preferably both, damaged extremity of the discarded winding core is restored will now be described. As mentioned above, the winding core 12 is preferably a discarded winding core having first and second crimped extremities, each of the crimped extremities being internally ground to provide the corresponding one female joint socket 40 therein. As illustrated, each of the extremities 20, 22 of the discarded winding core 12 is advantageously internally ground on a predetermined grinding distance 36 to respectively provide an internal ground portion 38 thereon. Each of the ground portions 38 defines a respective one female joint socket 40 extending at the corresponding extremity 20, 22. The restored winding core 100 is advantageously further provided with first and second hollow insert tubes 44. Each of the insert tubes 44 are inserted inside a respective one of the female joint sockets 40 for respectively providing first and second restored core extremities. Preferably, each of the female joint sockets 40 has the same predetermined socket length, and each of the insert tubes 44 has a length corresponding to the predetermined socket length. Thus, the insert tubes 44 are advantageously mounted flush inside the winding core 12. Thus, at this point, the restored winding core 100 can be reused as such. Still preferably, each of the female joint sockets 40 has a predetermined socket thickness. Each of the insert tubes 44 advantageously has a cylindrical wall of a predetermined wall thickness corresponding to the socket thickness, thereby providing a surface continuity inside the restored winding core 100.

In a further embodiment, the insert tubes 44 are advantageously connected to the winding core 12 with an adhesive such as a glue (not shown) to provide a conveniently strong assembly. The adhesive is advantageously applied on the outer surface of the insert tube 44, preferably on the whole outer surface, to provide a uniform connexion between the inserts 44 and the winding core 12. More preferably, the adhesive is also applied on the internal ground portion 38 before insertion of the insert tubes 44 inside the corresponding extremity 20, 22 of the winding core 12.

With reference now to FIGS. 3A to 3C and also to FIG. 5, a second preferred embodiment of the present invention wherein at least a first and a second discarded winding cores 12 are advantageously joined end to end will now be described. As explained above, each of the discarded winding cores 12 have a first and a second extremity 20, 22 which are internally ground on a predetermined grinding distance 36 to remove the crimping portions 16, 18 and provide an internal ground portion 38 on each of the extremities 20, 22. These ground portions 38 are preferably identical to each other and each defines a female joint socket 40 extending at one of the corresponding extremities 20, 22 of the corresponding discarded winding core 12, thereby providing a corresponding machined core 42.

Still referring to FIGS. 3A to 3C and also to FIGS. 6A to 7B, at least one hollow insert tube 44 diametrically snugly fitting into the female joint socket 40 is then provided for connecting two machined cores 42 together. In this second preferred embodiment, the insert tube 44 advantageously has a length corresponding to twice the grinding distance 36, i.e. the socket length, to allow the connexion between the two machined cores 42. The insert tube 44 is then inserted inside the corresponding joint sockets 40 of two distinct machined cores 42 for joining them end to end. In other words, a first tube extremity 46 of the insert tube 44 is first inserted into one of the female joint sockets 40 of a first machined core 42. A second machined core 42 is then connected to the first one by inserting the second tube extremity 48 of the insert tube 44 into one of the female joint socket 40 of the second machined core 42, thereby providing an assembly 50 of two machined cores 42. Such an assembly 50 will now be referred to as the recycled master core 50. Of course, a plurality of insert tubes 44 can advantageously be provided for connecting several machined cores 42 together. The insert tube 44 preferably has a diameter that fits in an adjusted relationship into the corresponding female joint socket 40. In other words, once inserted in the corresponding female joint sockets 40 of two distinct machined cores 42, the connecting tube 44 advantageously perfectly fills the two corresponding facing ground portions 38 of the two machined cores 42. The hollow insert tube 44 advantageously has a cylindrical wall of a predetermined thickness corresponding to the thickness of the ground portions 38. Thus, the insertion of the insert tube 44 between two machined cores 42 does not generate any surface discontinuity inside the two assembled machined cores 42. In the present method, the insert tube 44 is advantageously connected to the machined cores 42 with an adhesive such as a glue (not shown) to provide a conveniently strong assembly. The adhesive is advantageously applied on the outer surface of the insert tube 44, preferably on the whole outer surface, to provide a uniform connexion between the two machined cores 42. More preferably, the adhesive is also applied on the corresponding internal ground portions 38 of the machined cores 42 before insertion of the insert tube 44 therein.

Still referring to FIGS. 3B and 3C, it should be noted that a hollow ending tube 64 diametrically snugly fitting into the female joint sockets 40 can advantageously be inserted into a corresponding female joint socket 40 extending at an end of the recycled master core 50 for ending the recycled master core 50. The ending tube 64 advantageously has a length corresponding to the grinding distance 36. In this manner, no trimming is required and the whole length of the discarded cores 12 is then advantageously used. Like the insert tube 44, the ending tube 64 can advantageously be secured to the recycled master core 50 with an adhesive, glue for example, applied on the outer surface of the hollow ending tube 64 and on the corresponding female joint socket 40. Moreover, still like the insert tube 44, the hollow ending tube 64 advantageously has a cylindrical wall of a predetermined thickness corresponding to the thickness of the ground portions 38. Thus, the insertion of the ending tube 64 at an end of the recycled master core 50 does not generate any surface discontinuity inside the recycled master core 50.

Figure 8A:
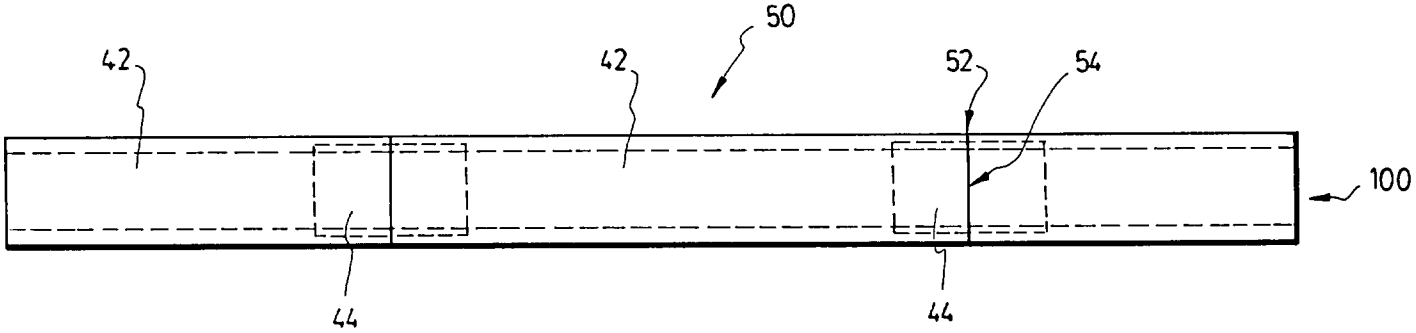
FIGS. 8A and 8B are schematic representations of a restored winding core according to the present invention.
Figure 8B:
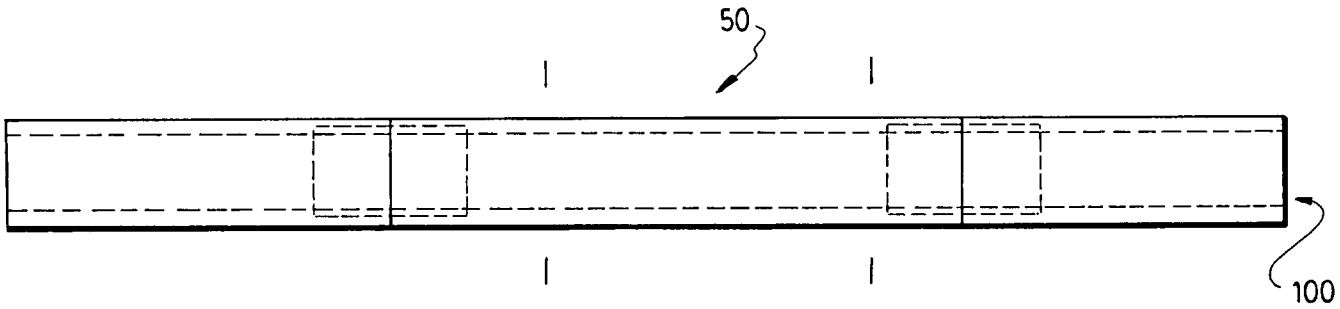
Figure 8C:
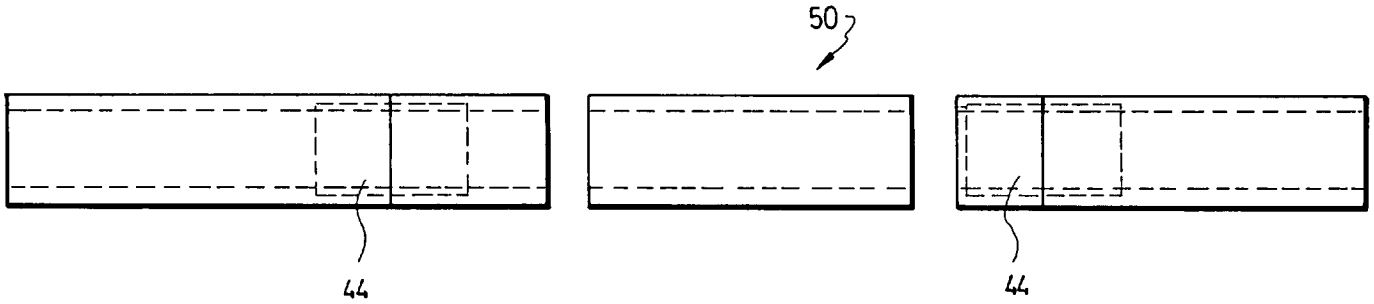
FIG. 8C is a schematic representation of the restored winding core shown in FIGS. 8A and 8B, the core having been cut.
Figure 9:
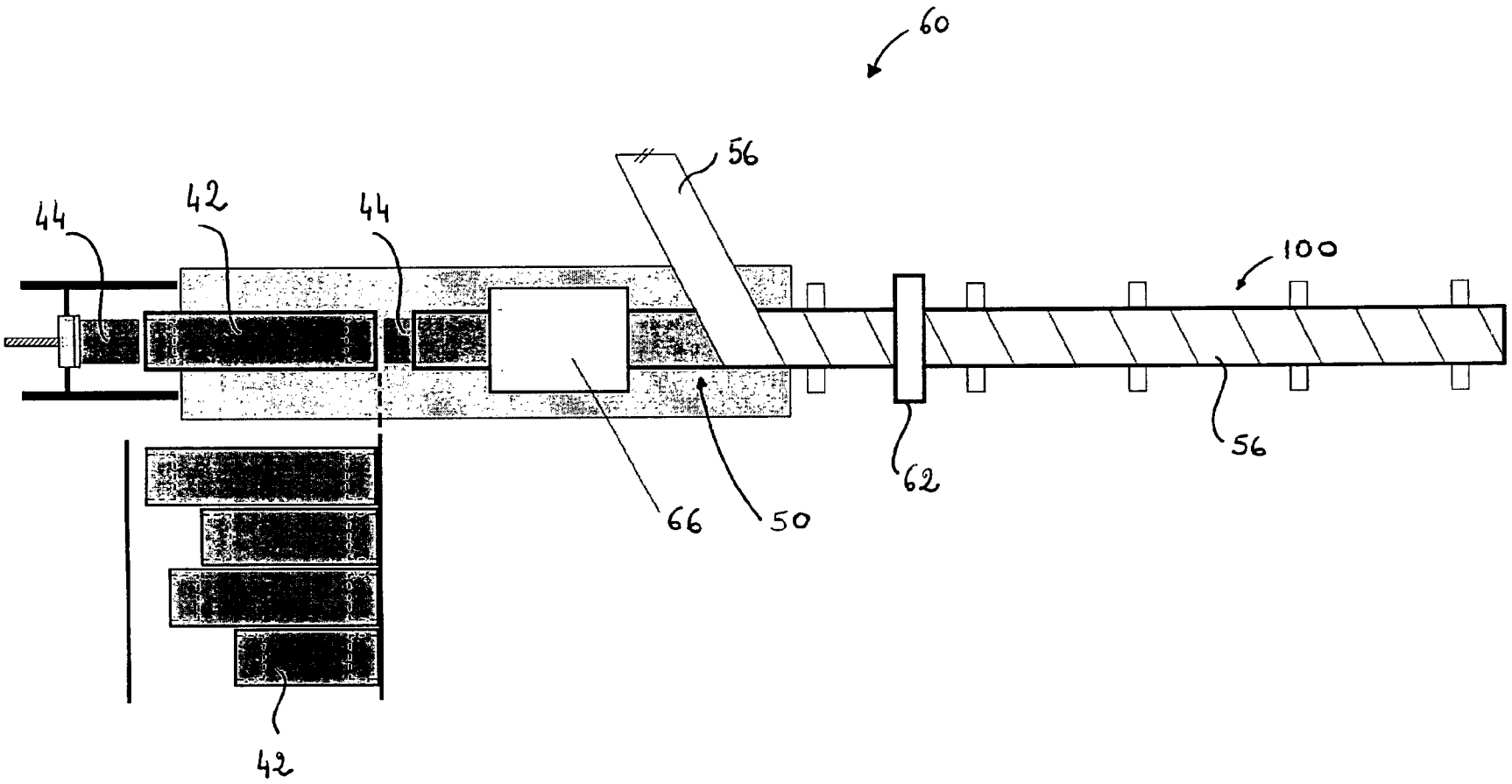
FIG. 9 is a schematic representation of an apparatus for manufacturing restored winding cores according to a preferred embodiment of the present invention.

Now with reference to FIGS. 8A to 9, to provide a recycled master core 50 having a convenient length, several machined cores 42 may have to be joined end to end. The recycled master core 50 thus presents surface irregularities 52 at each machined core junction 54. These surface irregularities 52, even if they seem negligible, can cause considerable damage to the paper during its winding on the recycled master core 50. To alleviate this situation, the recycled master core 50 is then coated over its entire length with a finishing fold 56. The surface irregularities 52 of the recycled master core 50 are then absorbed by the finishing fold 56. The finishing fold 56 is wound, preferably spirally wound, around the recycled master core 50. More preferably, before the winding of the finishing fold 56 around the recycled master core 50, an adhesive, such as glue, is advantageously applied on the finishing fold 56. One could also envisage to apply the adhesive on the recycled master core 50. At this point, a restored winding core 100 having the appearance of a new one is obtained. As already mentioned, any number of machined cores 42 can be joined end to end to manufacture a restored winding core 100 of any convenient length. The restored winding core 100 can then advantageously be cut to any convenient length since no more surface irregularities 52 appear on the surface of the restored winding core 100. With the above-described method known in the prior art, the web of finishing material has to have a length equivalent to the length of the multi-length core master. This characteristic makes the manufacturing of a long master core more complex and could even prevent such a manufacturing. On the contrary, with the method of the present invention, the finishing fold 56 is easily and quickly applied on a recycled master core 50 of any convenient length.

With the above-described manufacturing method, a restored winding core is then provided. Referring again to FIGS. 8A to 8C and also to FIGS. 3B and 3C, there is shown a restored winding core 100 according to the present invention. The restored winding core 100 has at least two winding cores 12, preferably discarded used winding cores, each of the winding cores 12 having a first and a second extremity 20, 22 provided with a female joint socket 40 extending therein. The restored winding core 100 is also provided with at least one hollow insert tube 44 having a diameter snugly fitting into the female joint sockets 40. One of the insert tubes 44 extends between two winding cores 12 inside the corresponding female joint sockets 40 for joining the two winding cores 12 end to end, thereby providing a recycled master core 50. The recycled winding core 50 is also provided with a finishing fold 56 wound, preferably spirally wound, around the recycled master core 50 over the entire length thereof, thereby providing the restored winding core 100. As mentioned above, each of the female joint sockets 40 preferably has a predetermined socket length, and the hollow insert tube 44 advantageously has a length corresponding to twice the predetermined socket length. Also preferably, the diameter of the hollow insert tube 44 fits in an adjusted relationship into the corresponding joint socket 40. Still preferably, the restored winding core 100 is further provided with adhesive for bonding the finishing fold 56 to the recycled master core 50. Also preferably, the insert tube 44 and the corresponding winding cores 42 are bonded together with adhesive. Moreover, as can be seen on FIG. 4 and as already mentioned, in a preferred embodiment, each of the winding cores 12 comprises a discarded winding core having first and second crimped extremities 16, 18. Each of the crimped extremities 16, 18 is internally ground to provide the corresponding one female joint socket 40 therein. In the preferred embodiment illustrated on FIG. 8A, three discarded winding cores 12 are joined together end to end but it should be understood that any convenient number of winding cores 12 could be joined end to end. When the convenient number of winding cores 12 has been joined to form the restored winding core 100, one can then cut the restored winding core 100 to a convenient length.

Referring again to FIG. 9, there is shown a preferred apparatus 60 for manufacturing restored winding cores 100. Since the needs of the paper mills can be variable, it can be interesting for them to order very long winding cores which will be cut in house, according to the specific needs. In this case, it is advantageous to provide them with very long winding cores, such as 310 inches long, for example, even if any other particular length could be envisaged. The known prior art method for recycling winding cores cannot provide such long winding cores. The present apparatus 60 for manufacturing restored cores is supplied with machined cores 42 of any length and is also supplied with insert tubes 44. The apparatus 60 connects a plurality of machined cores 42 end to end by inserting an insert tube 44 therebetween, as explained above, for providing a recycled master core 50. The master core 50 is then swept along by a spirally winding system 66, as well known in the art. While the apparatus 60 is still supplied with machined cores 42 and insert tubes 44, the master core 50 is formed and moves forward with a rotational movement. The finishing fold 56 is then spirally applied around the master core 50, thereby providing the restored winding core 100. The apparatus 60 is also provided with saw means 62 for sawing the restored winding core 100 to a convenient length, for example 310 inches long. During the cut, the blade of the saw means 62 can advantageously move at the same speed as the restored winding core 100, so that the process can be continuously performed. Of course, any other apparatus for manufacturing the restored winding core of the present invention could also be envisaged.

A person well versed in the art would understand that the present method for restoring winding cores is not limited to a single recycling cycle. Indeed, one can recycle a winding core which has already been restored once. It should nevertheless be noted that the external diameter of the restored winding core will increase according to the number of recycling cycles the core has been subject to. However, it is still even possible to recycle a discarded winding core several times by adding an optional sandblasting step to the present method. This sandblasting step will be performed prior to the winding of the finishing fold 56 for grinding the outer surface of the recycled master core 50 to a constant outer diameter slightly inferior to the outer diameter of an original winding core. Of course, it is also possible to perform the sandblasting step prior to the insertion of the insert tube 44 inside the joint sockets 40 of the machined cores. In this case, each of the collected discarded winding cores is then sandblasted for grinding the outer surface thereof.

With the present described method, the manufacturing of restored winding cores can advantageously be in-line performed, thereby providing a practical and economical manufacturing.

The present method for restoring winding cores is particularly advantageous since it allows manufacturing restored winding cores meeting the technical requirements of the paper mills while manufacturing such winding cores in an ecological manner.

Although preferred embodiments of the present invention have been described in detail herein and illustrated in the accompanying drawings, it is to be understood that the invention is not limited to these precise embodiments and that various changes and modifications may be effected therein without departing from the scope of the present invention.

What is claimed is:

1. A method for manufacturing restored winding cores comprising the steps of:

a) collecting discarded winding cores, each of said cores having a first and a second extremity;

b) internally grinding on a predetermined grinding distance each of said extremities of each of said discarded winding cores to provide internal ground portions thereon, said ground portions defining corresponding female joint sockets, each having a predetermined socket length and a predetermined socket thickness;

c) providing hollow insert tubes diametrically snugly fitting into the female joint sockets, each of said hollow insert tubes having a cylindrical wall of a predetermined wall thickness corresponding to said socket thickness and a length corresponding to twice the predetermined socket length;

d) supplying an apparatus with the discarded winding cores of step b) and with the plurality of hollow insert tubes of step c), the apparatus inserting each of said hollow insert tubes inside the corresponding joint sockets of successive ones of the discarded winding cores for joining said discarded winding cores end to end to form a recycled master core having an internal surface continuity therein, the recycled master core being moved forward by the apparatus with a rotational movement;

e) spirally winding a finishing fold around the recycled master core and therealong for providing an endless restored winding core; and f) cutting said endless restored winding core to a predetermined length, wherein said steps d), e) and f) are performed continuously on the same apparatus.

2. The method according to claim 1, further comprising, before step d), additional steps of:

providing adhesive; and applying said adhesive on an outer surface of each of said hollow insert tubes and/or on each of said internal ground portions.

3. The method according to claim 1, further comprising, before step f), an additional step of sandblasting the recycled master core for grinding an outer surface thereof.

4. The method according to claim 1, further comprising, before step d), an additional step of sandblasting each of said discarded winding cores for grinding an outer surface thereof.

5. The method according to claim 1, further comprising, before step f), additional steps of:

providing adhesive; and applying said adhesive on an outer surface of the recycled master core.

6. The method according to claim 1, wherein in step a), the extremities comprise crimped portions, the method lacking a step in which crimped portions are trimmed.

7. The method according to claim 1, wherein in step d), the recycled master core is moved forward at a given speed and wherein step g) comprises moving a saw blade at the speed of the endless recycled master core.

* * * * *